US006530476B1

(12) United States Patent
Overholt

(10) Patent No.: US 6,530,476 B1
(45) Date of Patent: Mar. 11, 2003

(54) PALLET STACKING DEVICE

(75) Inventor: Trenton M. Overholt, Orlando, FL (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 09/420,431

(22) Filed: Oct. 12, 1999

Related U.S. Application Data

(60) Provisional application No. 60/105,603, filed on Oct. 26, 1998.

(51) Int. Cl.[7] ..... B65D 19/32

(52) U.S. Cl. ..... 206/386; 108/55.3; 108/57.28; 108/57.29; 108/901; 206/427

(58) Field of Search ..... 108/55.3, 57.18, 108/57.28, 57.29, 901, 902; 206/427, 429, 386

(56) References Cited

U.S. PATENT DOCUMENTS

| | | | | | |
|---|---|---|---|---|---|
| 3,964,607 | A | * | 6/1976 | Wagner | 206/427 |
| 4,360,231 | A | | 11/1982 | Bolin | |
| 4,567,981 | A | | 2/1986 | Headon | |
| 4,653,651 | A | * | 3/1987 | Flum | 211/59.4 |
| 4,735,321 | A | | 4/1988 | Day | |
| 4,865,202 | A | * | 9/1989 | Day | 206/597 |
| 4,930,632 | A | * | 6/1990 | Eckert et al. | 206/386 |
| 5,016,761 | A | | 5/1991 | Stoddard et al. | |
| 5,213,211 | A | | 5/1993 | Umiker | |
| 5,330,050 | A | | 7/1994 | Stansbury, Jr. et al. | |
| 5,360,112 | A | * | 11/1994 | Beauchamp | 206/427 |
| 5,525,030 | A | * | 6/1996 | Buchman | 414/789.5 |
| 5,529,176 | A | * | 6/1996 | Apps et al. | 206/201 |
| 5,675,960 | A | * | 10/1997 | Weaver | 53/397 |
| 5,758,771 | A | * | 6/1998 | Rose | 206/386 |
| 5,894,804 | A | | 4/1999 | Werner | |

OTHER PUBLICATIONS

International Search Report of Application No. PCT/US99/24928 dated Jan. 24, 2000.

* cited by examiner

*Primary Examiner*—Janice L. Krizek

(57) ABSTRACT

The present invention provides an interface between stacked arrays of containers having container tops. The interface includes a pallet loaded with a stacked array of containers and a layer of exposed container tops adjacent the pallet. A plastic coupling member is positioned between the layer of exposed container tops and the pallet. The plastic coupling member includes a contoured surface configured with an array of indentations formed therein and properly spaced to mate with each of the layer of exposed container tops. The array of indentations is sufficiently deep to prevent relative lateral displacement of the coupling member with respect to the layer of exposed container tops. A method of vertically stacking crates using such an interface is also provided.

20 Claims, 11 Drawing Sheets

PALLET STACKING DEVICE

CROSS-REFERENCE TO RELATED APPLICATION

This application claims the benefit of U.S. provisional patent application Serial No. 60/105,603, filed Oct. 26, 1998.

TECHNICAL FIELD

The present invention relates to a pallet stacking device which maximizes vertical stacking capability of loaded pallets.

BACKGROUND OF THE INVENTION

Bottle carrying crates are often stacked in vertical sets on top of pallets. For example, two liter bottle crates may be stacked in sets of three to seven. A pallet loaded with such a stack of bottle crates may be properly handled by a forklift for shipment or storage. Generally, stacking more than four or five crates vertically on a pallet can create stability or handling problems.

Because height in a warehouse is significantly less expensive than floor space, it is desirable to stack fully loaded pallets vertically as high as possible. However, various problems arise in stacking loaded wood pallets on top of other fully loaded pallets. The wood pallet must rest upon the bottle caps of the top crate of the loaded pallet upon which it is to be stacked. Generally, wood pallets only have three spaced apart horizontal slats, therefore weight of the loaded pallet is not properly distributed because only the three slats resting upon a portion of the bottle caps below will support the load. This configuration may be unstable. Also, this configuration may lead to a "flowering" affect wherein the outer row of bottles or cans may tend to lean outwardly.

One prior art attempt to increase the stacking capacity of fully loaded pallets is to place a plywood sheet on top of the highest crate so that the plywood rests on top of the bottle caps or can tops. In this manner, the weight of the pallet or pallets stacked on top of the plywood sheet may be more evenly distributed to all bottle caps. However, the use of plywood sheets is problematic because when the plywood gets wet it tends to warp, and the plywood may also splinter which can create handling problems, particularly when the plywood does not have handles. Additionally, the plywood will have a significantly limited life span, particularly when the plywood gets wet.

Accordingly, it is desirable to provide an apparatus for maximizing the stacking capacity of pallets loaded with bottle crates or can crates so that the number of loaded pallets which may be vertically stacked is optimized.

SUMMARY OF INVENTION

The present invention overcomes the above-referenced shortcomings of the use of plywood in maximizing stacking capacity of pallets loaded with bottle crates or can crates by providing a plastic stacking member having on one side a contoured surface having grooves and ridges formed therein sufficiently to engage and support a variety of arrays of bottle caps or can tops, with fully loaded bottle crates or can crates. This invention promotes load stability through uniform axial loading of each bottle or can. The stacking member is also provided with handles on each peripheral edge, and with through-holes for cleaning, convenience and for drainage of spilled cartons.

More specifically, the present invention provides a method of vertically stacking crates loaded with liquid containers having container tops. The method includes the steps of: a) loading liquid containers into portable crates with the container tops exposed; b) arranging the loaded crates onto a first pallet in a vertically stacked configuration of crate layers; c) positioning a plastic coupling member on an uppermost crate layer in contact with the exposed container tops, the plastic coupling member having a contoured surface configured with an array of indentations formed therein and properly spaced to mate with each exposed container top of the uppermost crate layer, the array of indentations being sufficiently deep to prevent relative lateral displacement of the coupling member with respect to the exposed container tops of the uppermost layer; and d) stacking a fully loaded second pallet on the plastic coupling member, the second pallet being fully loaded with multiple crate layers including multiple crates loaded with liquid containers.

Another aspect of the invention provides an interface between stacked arrays of containers having container tops. The interface includes a pallet loaded with a stacked array of containers and a layer of exposed container tops. A plastic coupling member is positioned between the layer of exposed container tops and the pallet. The plastic coupling member includes a contoured surface configured with an array of indentations formed therein and properly spaced to mate with each of the layer of exposed container tops. The array of indentations are sufficiently deep to prevent relative lateral displacement of the coupling member with respect to the layer of exposed container tops.

Accordingly, an object of the present invention is to provide a method and apparatus for maximizing the stacking capacity of pallets loaded with bottle crates or can crates so that the number of loaded pallets which may be vertically stacked is optimized.

The above object and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
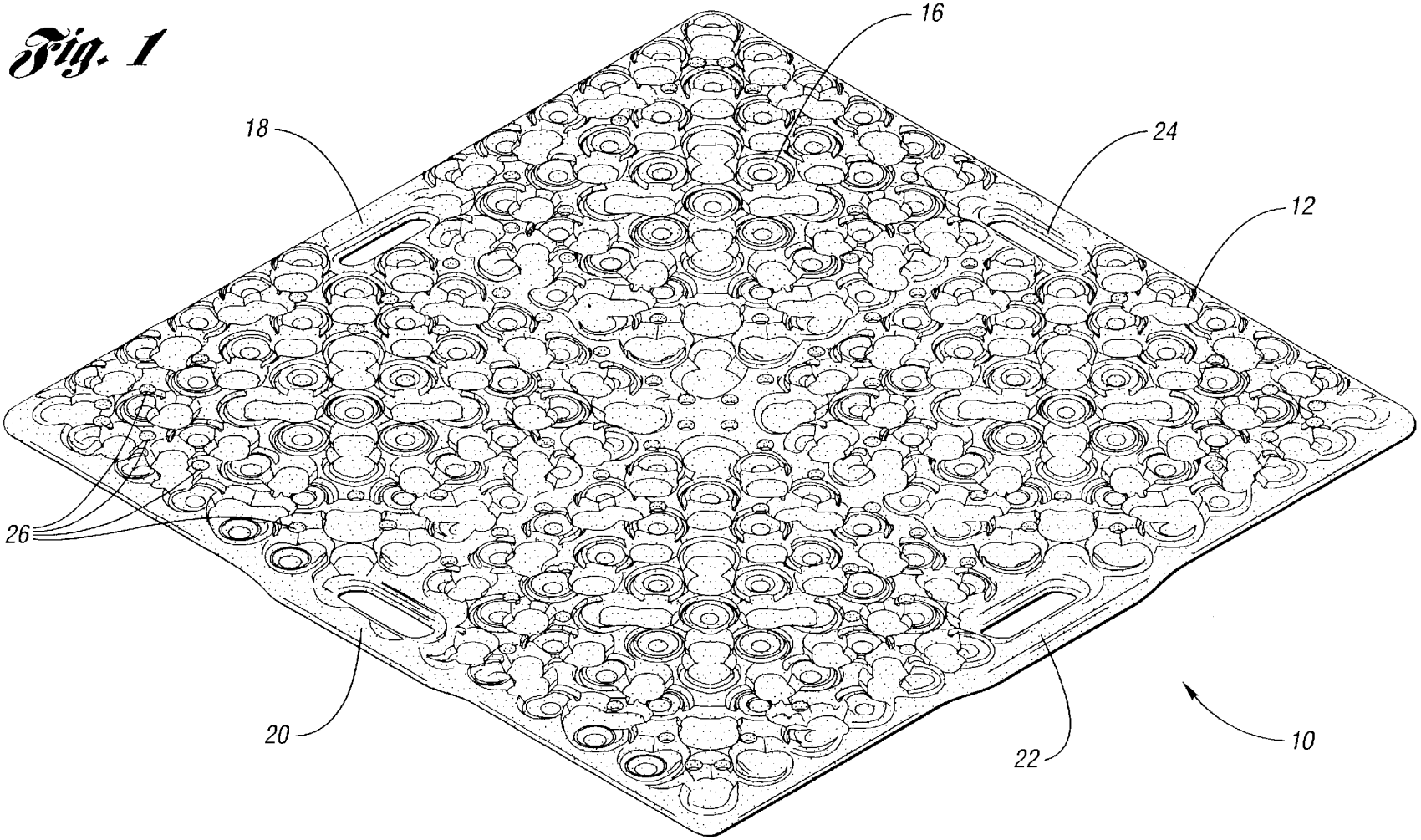
FIG. 1 shows a bottom perspective view of a stacking member in accordance with the present invention.
Figure 2:
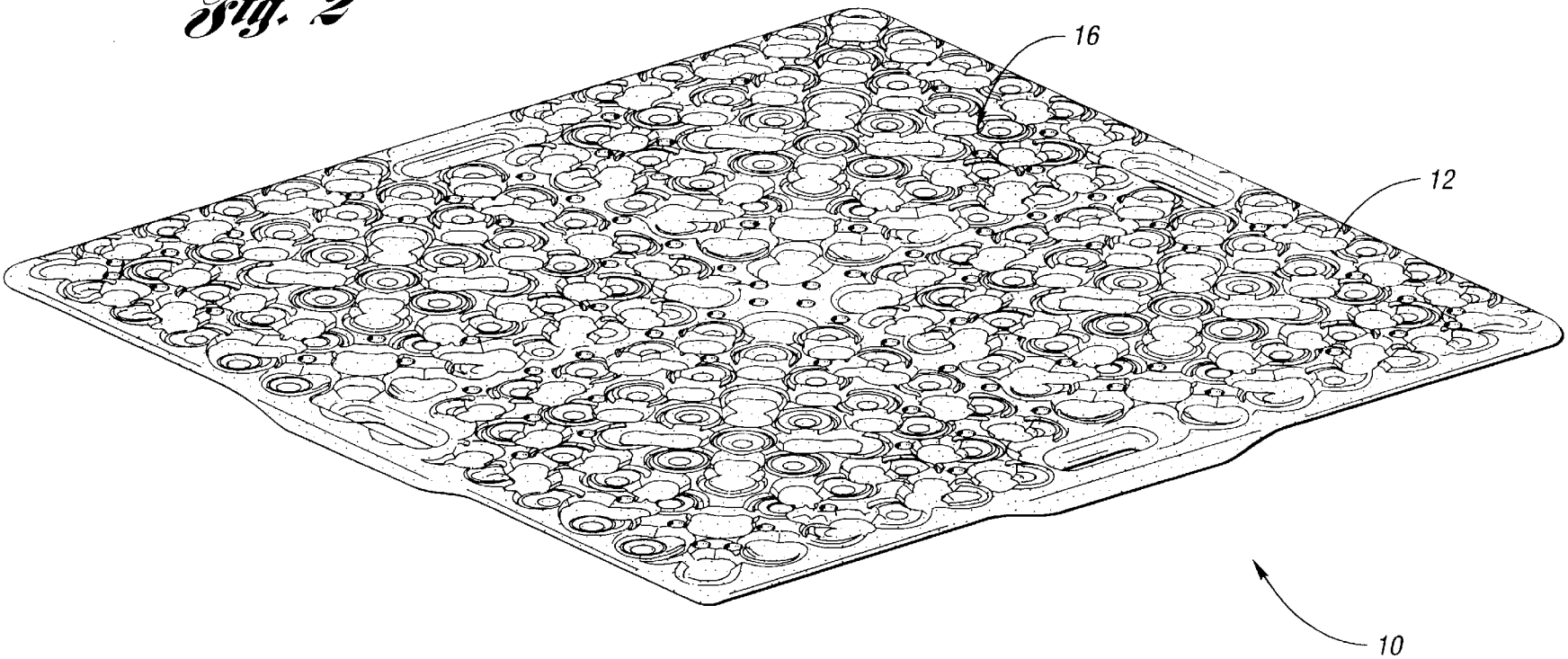
FIG. 2 shows a bottom perspective view of the pallet stacking member of FIG. 1.

Referring to FIGS. 1–4, a stacking member 10 is shown in accordance with the present invention for use in maximizing the stacking capacity of pallets which are fully loaded with bottle crates or can crates holding liquid containers, such as bottles or cans. As shown, the stacking member 10 has a bottom surface 12 and a top surface 14. The bottom surface 12 is configured with an array 16 of indentations including grooves and ridges configured to receive and support bottle caps (grooves 65, 67) or can tops (grooves 63) from a variety of adjacent crate configurations for properly supporting the bottle tops or can tops. Accordingly, such grooves and ridges of the array 16 are arranged symmetrically about the bottom surface 12 of the stacking member 10.

The stacking member (or coupling member) 10 also includes a plurality of handles 18,20,22,24, and an array of through-holes 26 across the surface of the stacking member 10 for drainage of spilled cartons, and also for minimizing weight of the stacking member 10 to reduce manufacturing costs.

Figure 3:
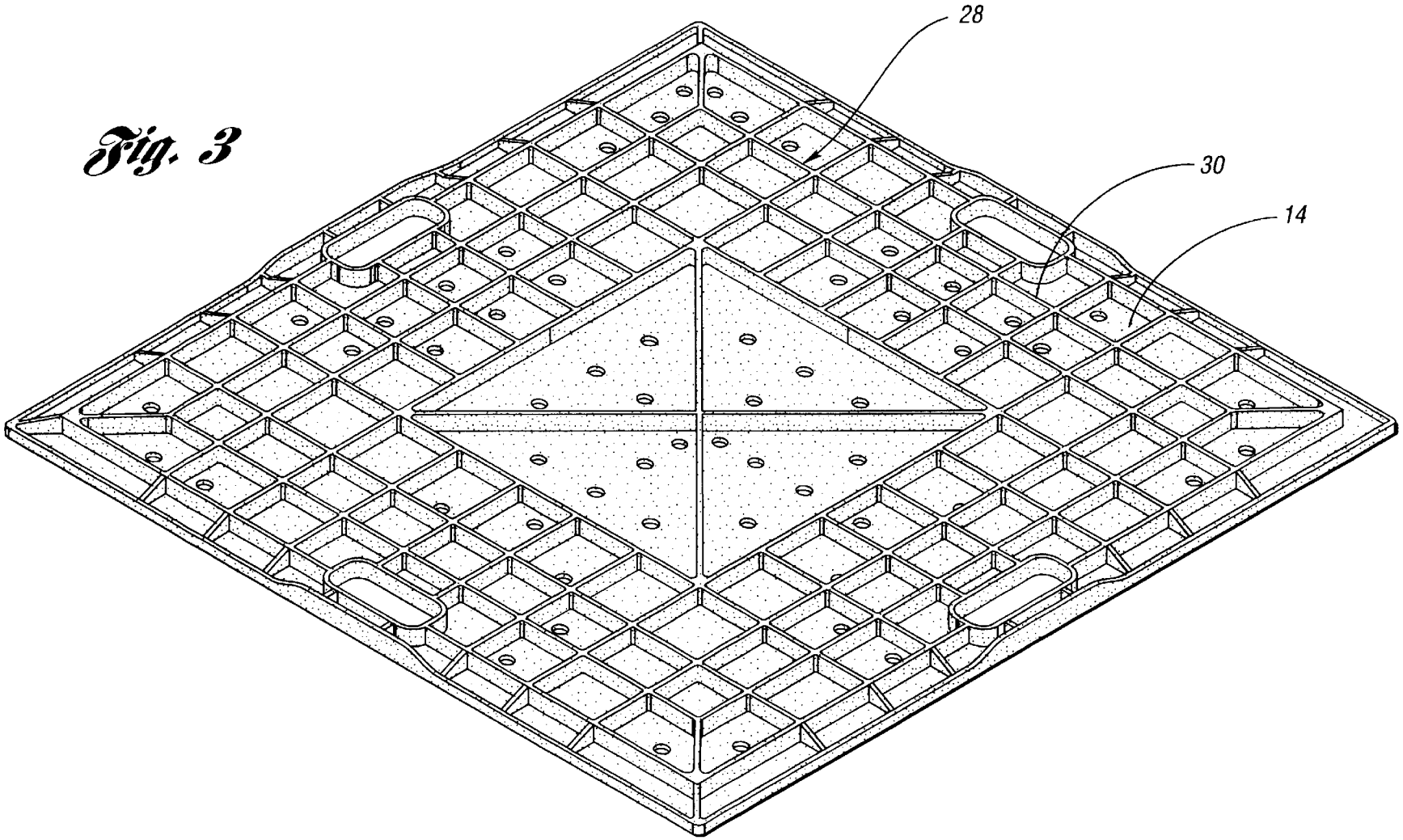
FIG. 3 shows a top perspective view of the stacking member of FIG. 1.
Figure 4:
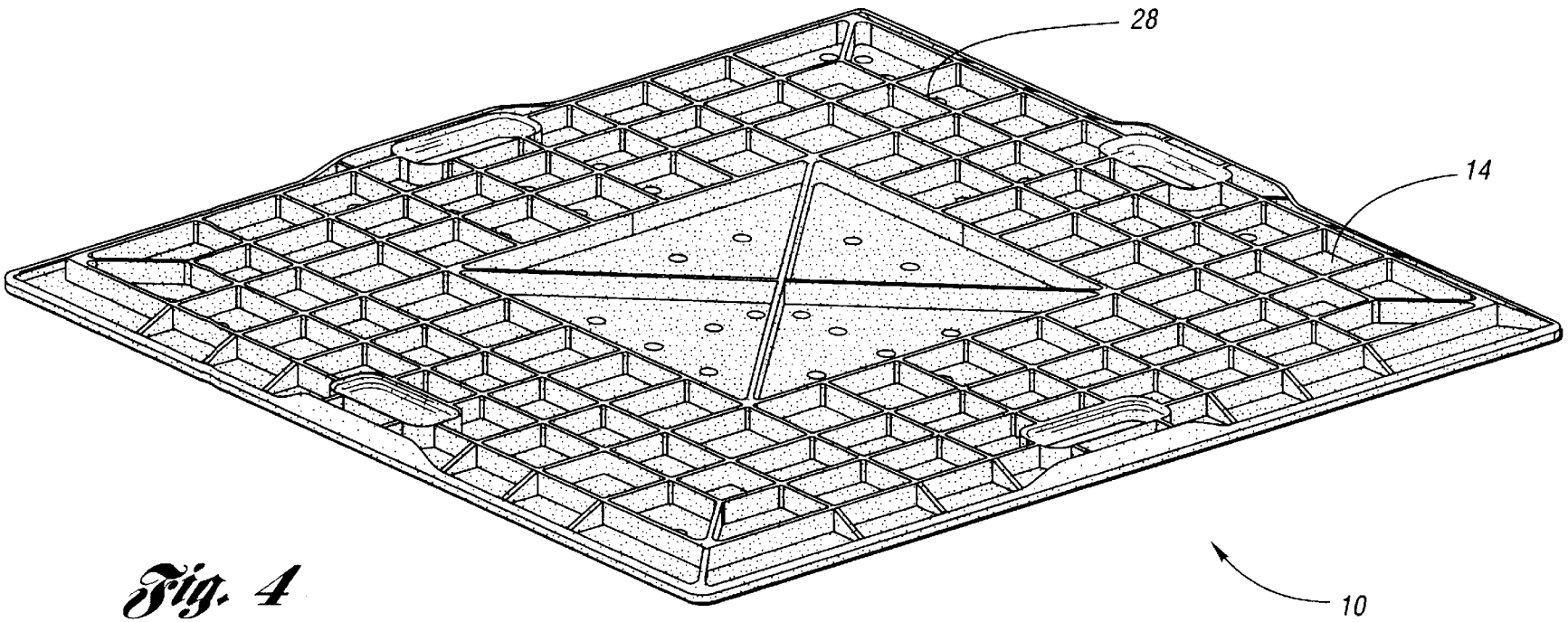
FIG. 4 shows a top perspective view of the stacking member of FIG. 1.

Referring to FIGS. 3 and 4, the top surface 14 of the stacking member 10 is provided with a vertical rib grid 28 which provides structural integrity to the stacking member 10. The top surface 30 of the grid structure 28 is configured along a common plane for supporting an adjacent pallet.

Figure 5:
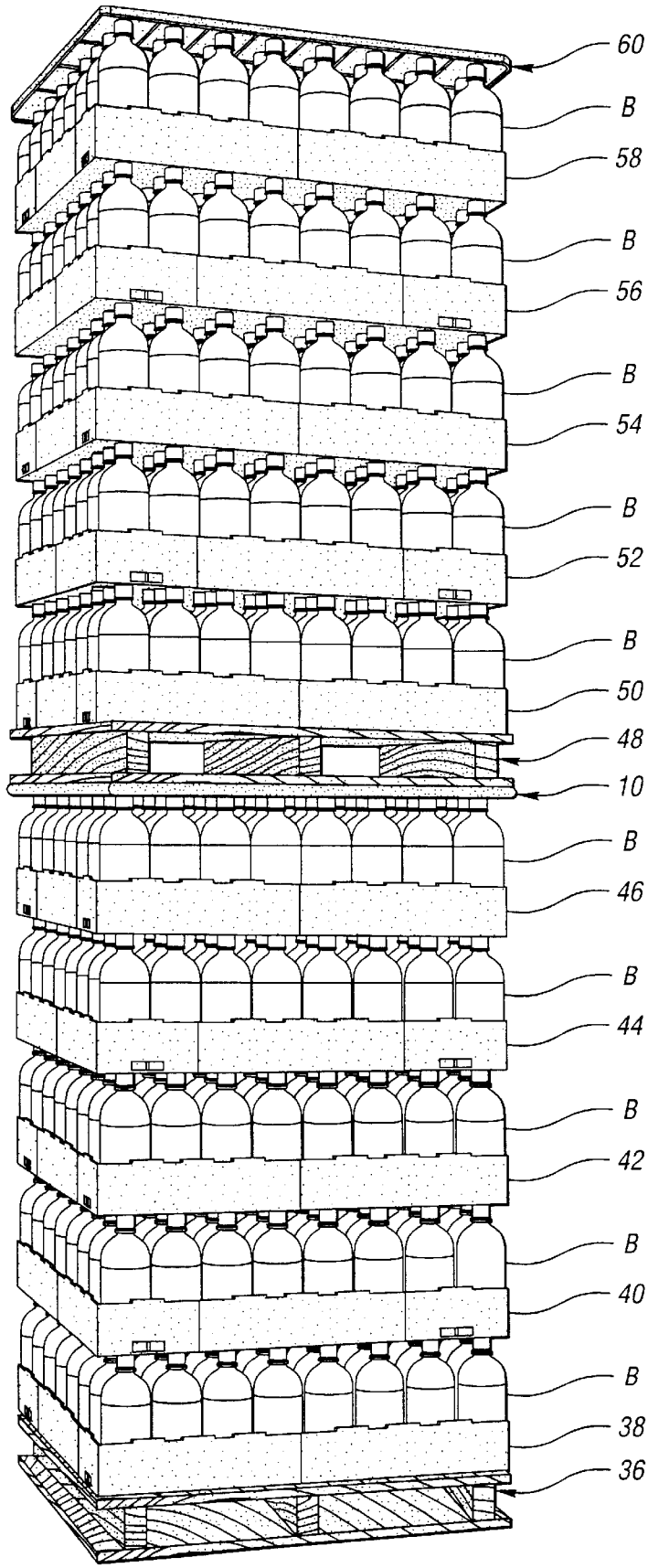
FIG. 5 shows a perspective view of a stacking member used in a stack of loaded pallets in accordance with the present invention.
Figure 6:
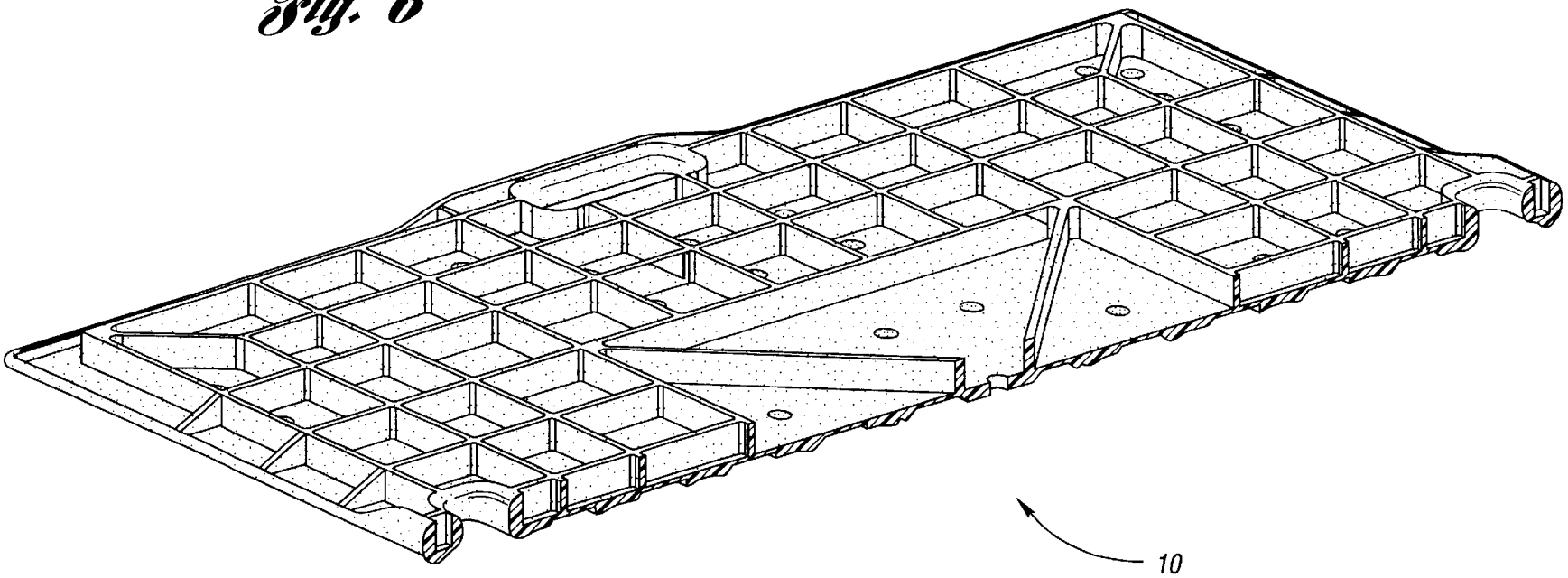
FIG. 6 shows a top perspective cut-away sectional view of the stacking member of FIG. 1.
Figure 7:
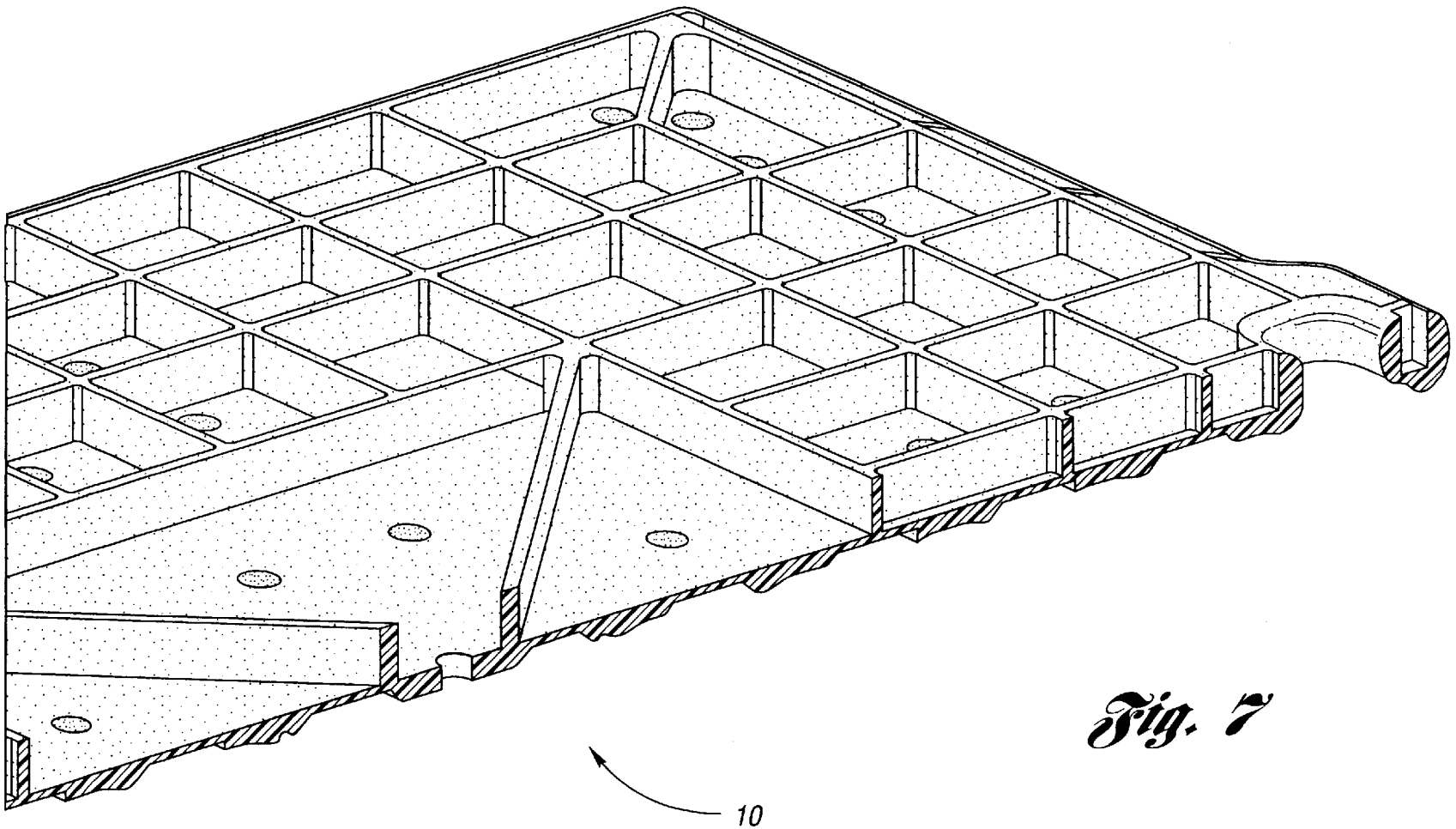
FIG. 7 shows an enlarged cut-away top perspective view of the stacking member of FIG. 6.
Figure 8:
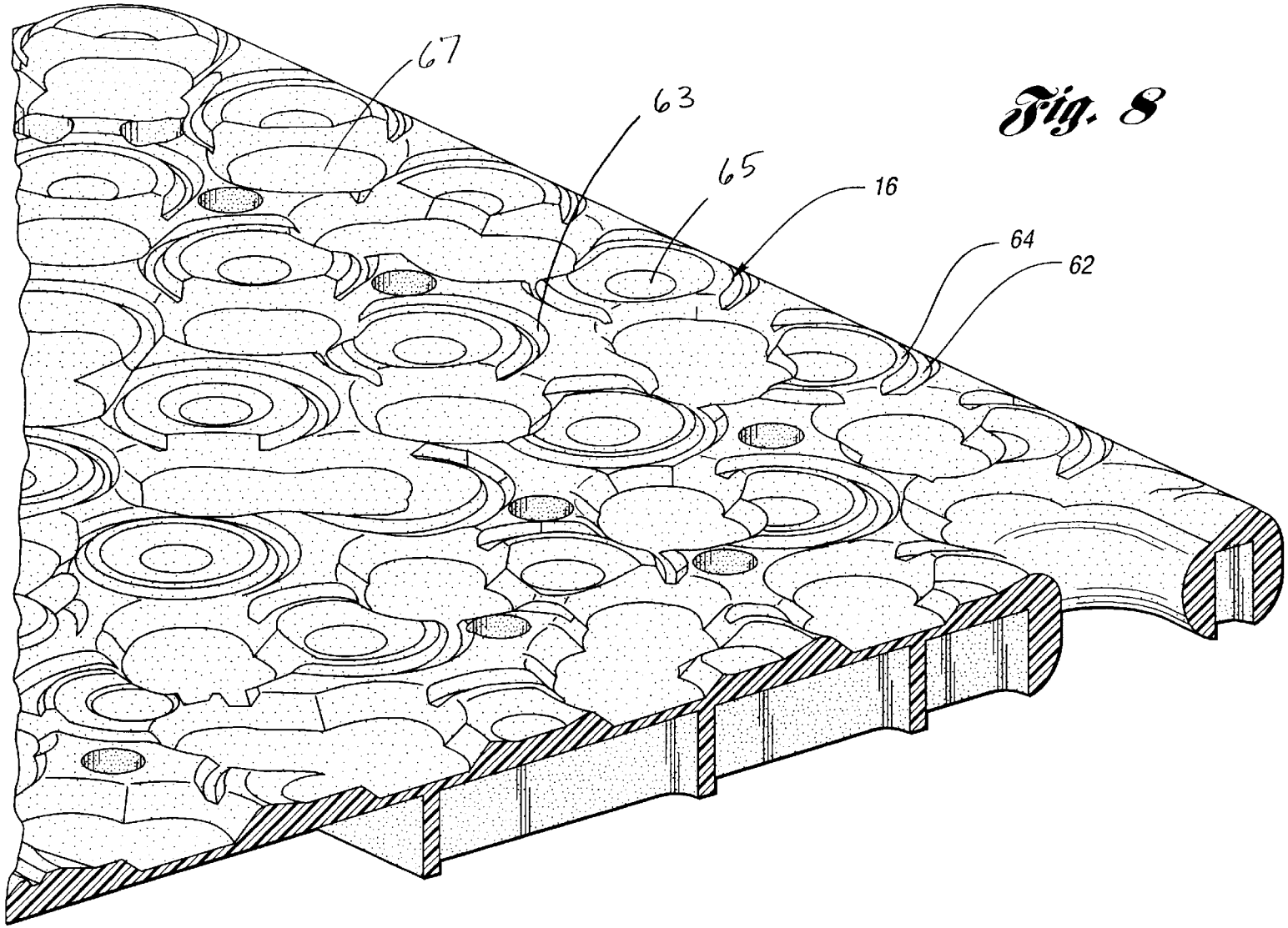
FIG. 8 shows an enlarged cut-away bottom perspective view of the stacking member of FIG. 1.
Figure 9:
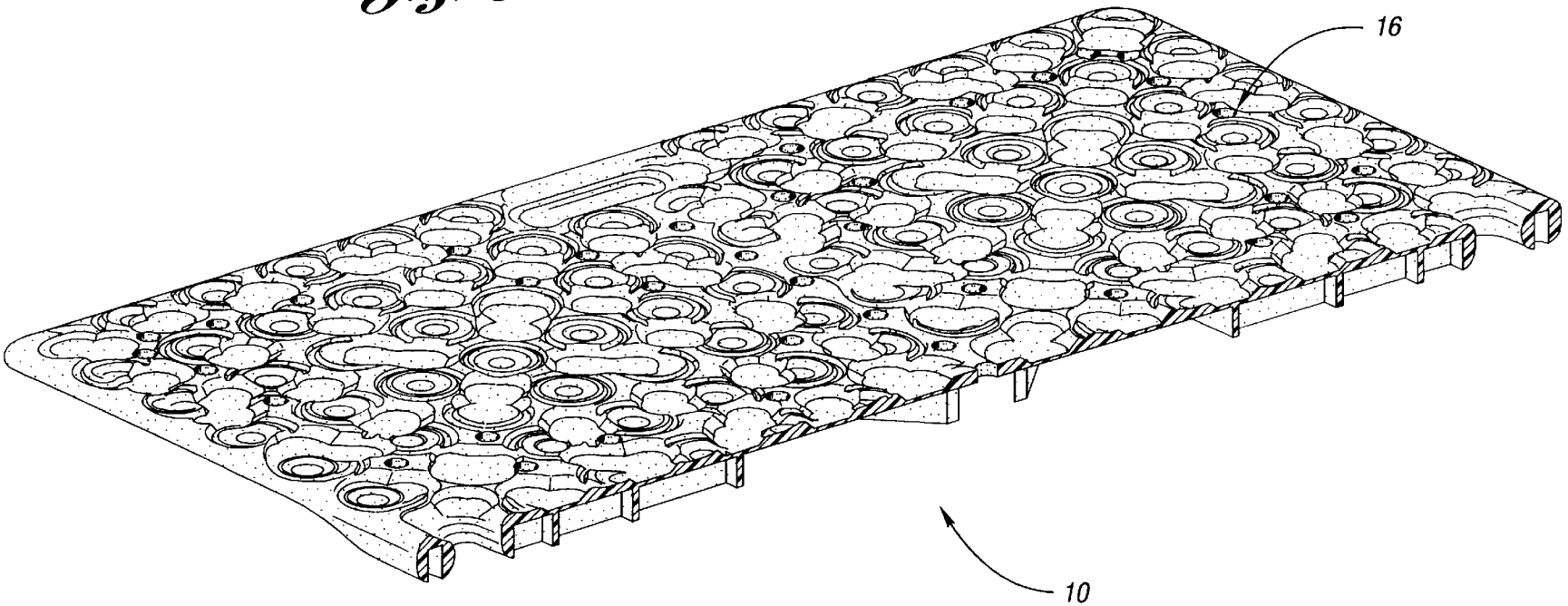
FIG. 9 shows a cut-away bottom perspective view of the stacking member of FIG. 1.
Figure 10:
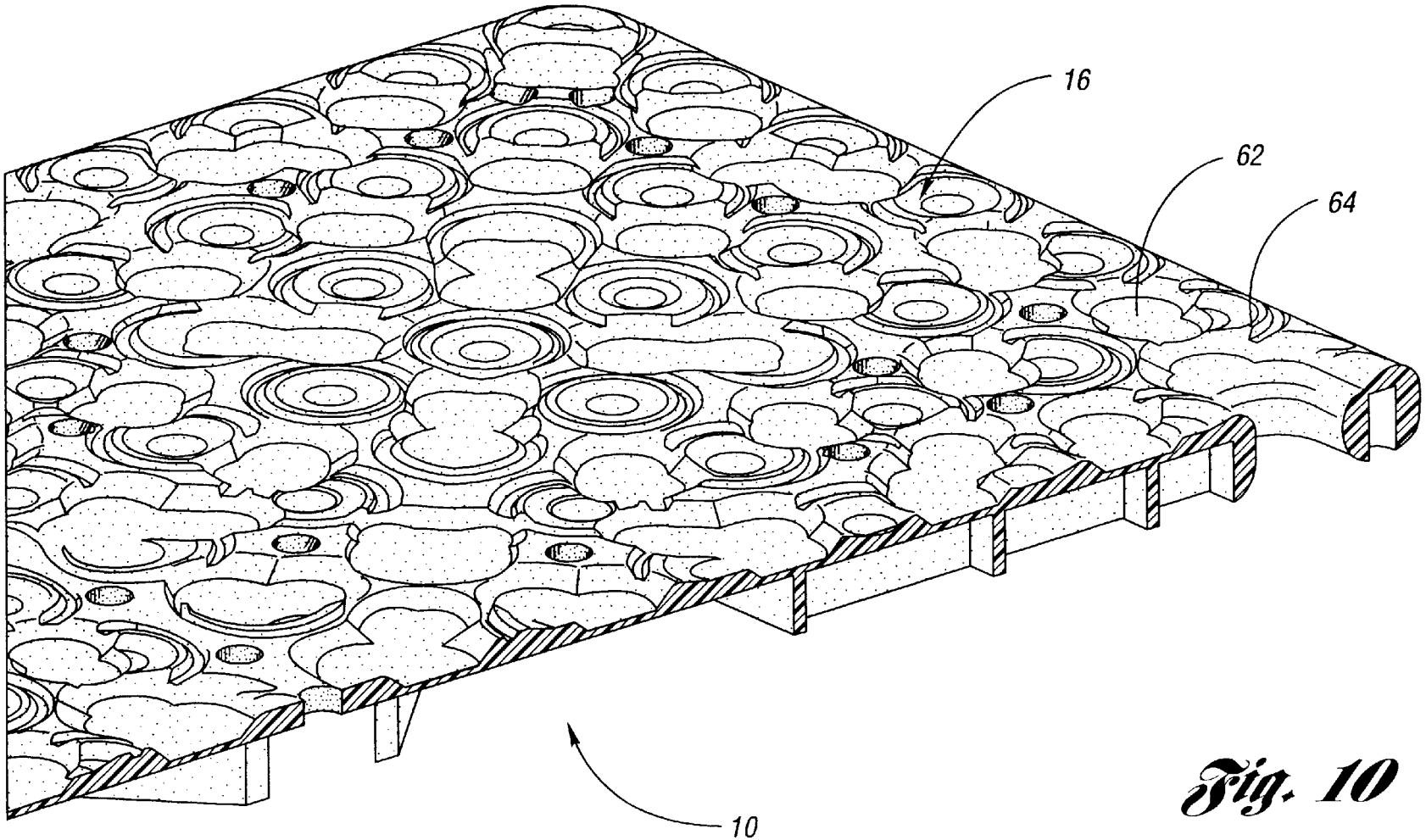
FIG. 10 shows an enlarged cut-away bottom perspective view of the stacking member of FIG. 9.
Figure 11:
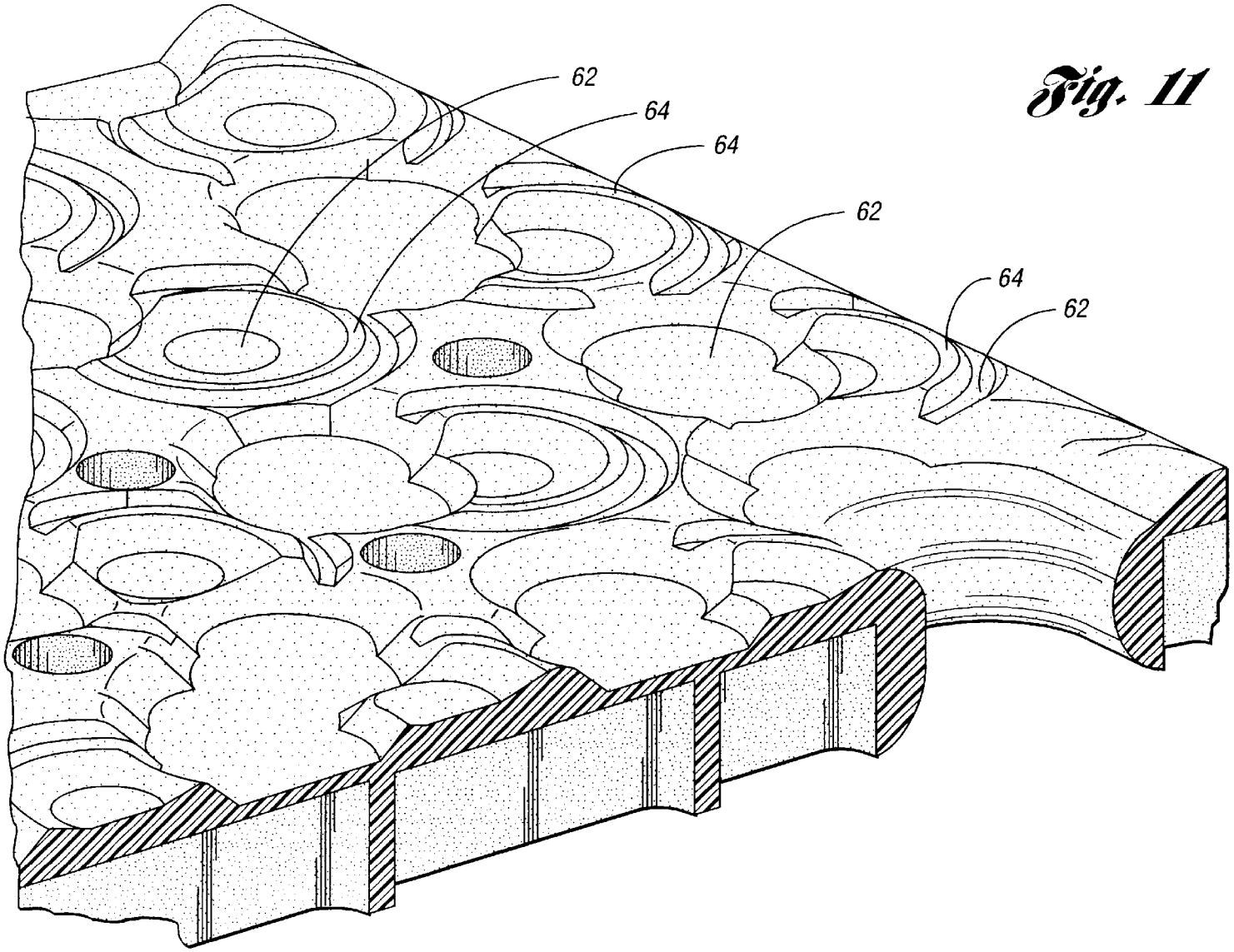
FIG. 11 shows an enlarged cut-away bottom perspective view of the stacking member of FIG. 10.

The stacking configuration is shown in FIG. 5. As shown, a fully loaded pallet 36 is loaded with five layers of crates 38,40,42,44,46, which are each loaded with bottles B. A stacking member (or coupling member) 10, as described previously with reference to FIGS. 1–4, is stacked on top of the bottle caps of the bottles B of the uppermost crate layer 46 so that the array 16 of grooves and ridges, as shown in FIGS. 1 and 2, cooperate with the bottle caps of the bottles on the crate layer 46 to improve stacking stability. A second pallet 48 is then stacked on top of the stacking member 10. In this manner, the stacking member 10, bottles B and pallet 48 form an interface between stacked arrays of containers. This design promotes load stability through uniform axial loading of each bottle or can, which reduces neck failures in bottles, and can failures are reduced as well.

The pallet 48 supports fully loaded layers of crates 50,52,54,56,58, which are each fully loaded with bottles B. The stacking member 10 provides uniform weight distribution of the loaded pallet 48 such that the weight is more evenly distributed through all of the bottle caps of the bottles supported on the crate layer 46. As shown, another stacking member 60 is provided on top of the bottles B of the crate layer 58 so that another fully loaded pallet may be stacked thereon. As shown, using the stacking member 10 of the present invention, pallets may be loaded with five bottle crates or can crates vertically, and three or more such loaded pallets may be stacked on top of each other with a stacking member 10 provided therebetween.

FIGS. 6–11 illustrate various cut-away perspective views of the stacking member 10 to properly illustrate the array 16 of indentations including grooves 62 and ridges 64 for properly supporting the loaded crates.

Preferably, the stacking member 10 of the present invention will be an injection molded component approximately ¾" to 1" in vertical cross-section. Preferred materials for manufacturing the stacking pallet 10 would be polypropylene or HDPE (high-density polyethylene). However, any suitable material would be sufficient.

While one embodiment of the invention has been illustrated and described, it is not intended that this embodiment illustrate and describe all possible forms of the invention. Rather, the words used in the specification are words of description rather than limitation, and various changes may be made within the scope of the appended claims.

What is claimed is:

1. An interface arranged to be positioned on a stacked array of containers having container tops, the interface comprising:

a stacked array of containers having a layer of exposed container tops of a first size; and a coupling member positioned on said layer of exposed container tops of the first size, said coupling member having a contoured surface configured with a plurality of indentations formed therein, wherein a first set of the plurality of indentations are properly spaced to mate with said layer of exposed container tops of the first size, said first set of the plurality of indentations having openings of the first size and being sufficiently deep to prevent relative lateral displacement of the coupling member with respect to said layer of exposed container tops of the first size and a second set of said plurality of indentations including openings of a second size, larger than the first size, and arranged to receive container tops of the second size.

2. The interface of claim 1, wherein said layer of exposed container tops of said first size comprises bottle tops.

3. The interface of claim 1, wherein said coupling member includes holes formed therethrough for drainage.

4. The interface of claim 1, wherein said coupling member comprises an overall thickness of less than approximately one inch.

5. The interface of claim 1, wherein the plurality of indentations include a plurality of arcuate slots.

6. The interface of claim 1, wherein the plurality of indentations include a plurality of annular recesses adapted to receive bottle tops.

7. The interface of claim 1, wherein the coupling member has a second surface opposite the contoured surface which includes a plurality of ribs members for providing structural integrity thereto.

8. The interface of claim 1, wherein the coupling member is formed of plastic.

9. An apparatus arranged for use in stacking loaded pallets, the apparatus comprising a coupling member adapted for positioning between a layer of first container tops of a plurality of first containers and a pallet, said coupling member having a contoured surface configured with a first array of indentations formed therein to receive the first container tops, said first array of indentations being sufficiently deep to prevent lateral displacement of the coupling member with respect to the first container tops and said contoured surface configured with a second array of indentations to receive a plurality of second container tops of a plurality of second containers, the second array of indentations having a spacing between indentations larger than a spacing between indentations in the first array.

10. The apparatus of claim 9, wherein at least one of said first and second arrays of indentations includes a plurality of arcuate slots.

11. The apparatus of claim 9, wherein at least one of said first and second arrays of indentations includes a plurality of annular recesses adapted to receive bottle tops.

12. The apparatus of claim 9, wherein the coupling member has a second surface opposite the contoured surface which includes a plurality of rib members for providing structural integrity thereto.

13. The apparatus of claim 9, wherein the coupling member is formed of plastic.

14. The apparatus of claim 9, wherein the coupling member comprises an overall thickness of less than approximately one inch.

15. An interface arranged to be stacked on a layer of containers having container tops, the interface comprising:

a stacking member having a first surface and an opposed second surface, the first surface including a plurality of indentations formed therein for receiving the exposed container tops, said plurality of indentations being sufficiently deep to prevent lateral movement of the stacking member relative to the layer of container tops, the indentations defining an array of relatively narrow, coplanar arcuate slots each configured to receive a rim of a can top, and the opposed second surface arranged to engage a support platform disposed thereabove; and a support platform supported directly on the second surface.

16. The device of claim 15, wherein the stacking member includes openings formed therethrough for drainage.

17. The device of claim 15, wherein said stacking member comprises an overall thickness of less than approximately one inch.

18. The device of claim 15, wherein the first surface also includes a plurality of recesses sized to receive the tops of bottles.

19. The device of claim 15, wherein the second surface includes a plurality of rib members for providing strength thereto.

20. The device of claim 15, wherein the stacking member is formed of plastic.

* * * * *

UNITED STATES PATENT AND TRADEMARK OFFICE

CERTIFICATE OF CORRECTION

PATENT NO. : 6,530,476 B1
DATED : March 11, 2003
INVENTOR(S) : Trenton M. Overholt It is certified that error appears in the above-identified patent and that said Letters Patent is hereby corrected as shown below:

Column 4,
Line 39, after "a plurality of", delete "ribs" and insert therefore -- rib --.

Signed and Sealed this

Ninth Day of December, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,530,476 B1
DATED : March 11, 2003
INVENTOR(S) : Trenton M. Overholt It is certified that error appears in the above-identified patent and that said Letters Patent is hereby corrected as shown below:

Column 4,
Line 39, after "a plurality of", delete "ribs" and insert therefore -- rib --.

Signed and Sealed this

Twenty-third Day of December, 2003

JAMES E. ROGAN
*Director of the United States Patent and Trademark Office*